United States Patent [19]

Freyman

[11] 4,341,387

[45] Jul. 27, 1982

[54] BOARD WORD GAME APPARATUS AND METHOD

[76] Inventor: Theodore M. Freyman, 9 Mill Rd., Melrose Park, Pa. 19126

[21] Appl. No.: 168,004

[22] Filed: Jul. 14, 1980

[51] Int. Cl.[3] ..... A63F 3/00

[52] U.S. Cl. ..... 273/240; 273/272

[58] Field of Search ..... 273/272, 273, 240

[56] References Cited

U.S. PATENT DOCUMENTS

| | | | |
|---|---|---|---|
| 2,752,158 | 6/1956 | Brunot | 273/272 |
| 3,655,195 | 4/1972 | Bean | 273/272 |
| 4,089,527 | 5/1978 | Roth | 273/273 |

FOREIGN PATENT DOCUMENTS

| | | | |
|---|---|---|---|
| 26175 | of 1910 | United Kingdom | 273/272 |
| 747598 | 4/1956 | United Kingdom | 273/272 |

OTHER PUBLICATIONS

"Scrabble" and Scrabble Crossword Cubes, 1966 Selchow and Righter Co. Catalog.

"Scarne's Encyclopedia of Games", by John Scarne, 1973, pp. 11, 12 only.

"The Way to Play", by the Diagram Group, Crosswords Game on p. 261 only.

*Primary Examiner*—Harland S. Skogquist

*Attorney, Agent, or Firm*—Nelson E. Kimmelman

[57] ABSTRACT

A playing board is divided into a number of discrete playing areas bearing respective numerals in a reading sequence. A plurality of game pieces such as cards or tiles, whose aggregate number approximates the number of the areas, respectively bear letters of the alphabet. The number of game pieces bearing a particular letter corresponds generally to the normal frequency of occurrence of that letter. The player makes a plurality of random draws of a certain number of the tiles and, attempting to form words or parts of words, places them on respective areas of the board in relative positions that form words or are likely to form parts of words in subsequent plays of subsequent draws. Each play of a draw is playable only in areas having higher numbers than those played in a previous draw except when a play can no longer be so made whereupon play can be made in low numbered areas toward the beginning of the board.

8 Claims, 8 Drawing Figures

AFTER PLAY NO. 5

| | | | | | | | | | |
|---|---|---|---|---|---|---|---|---|---|
| G | R | A | – | T | – | R | – | L | – |
| V | E | G | – | T | A | B | – | – | S |
| W | – | U | – | – | – | – | – | – | – |
| – | – | – | – | – | – | – | – | – | – |
| – | – | – | – | – | – | – | – | – | – |
| – | – | – | – | – | – | – | – | – | – |
| – | – | – | – | – | – | – | – | – | – |
| – | – | – | – | – | – | – | – | – | – |
| – | – | – | – | – | – | – | – | – | – |
| – | – | – | – | – | – | – | – | – | – |

FIG. 6A

AFTER PLAY NO. 17

| | | | | | | | | | |
|---|---|---|---|---|---|---|---|---|---|
| G | R | A | – | T | – | R | – | L | – |
| V | E | G | E | T | A | B | – | E | S |
| W | – | U | N | D | – | S | – | U | L |
| – | U | M | P | – | – | O | I | – | E |
| – | – | A | I | R | Y | – | H | – | L |
| M | – | T | – | – | – | K | E | R | – |
| – | A | S | T | – | – | Q | – | A | – |
| T | – | G | – | – | – | S | Y | – | – |
| D | – | – | T | – | – | – | – | – | – |
| – | – | – | – | – | – | – | – | – | – |

FIG. 6B

AFTER PLAY NO. 29

| | | | | | | | | | |
|---|---|---|---|---|---|---|---|---|---|
| G | R | A | N | T | – | R | – | L | – |
| V | E | G | E | T | A | B | L | E | S |
| W | O | U | N | D | – | S | O | U | L |
| D | U | M | P | – | P | O | I | S | E |
| – | H | A | I | R | Y | – | H | E | L |
| M | – | T | O | M | – | K | E | R | F |
| W | A | S | T | E | – | Q | U | A | R |
| T | – | G | O | – | A | S | Y | – | – |
| D | I | E | T | – | B | E | N | T | – |
| V | I | S | O | – | – | S | C | – | R |

FIG. 6C

BOARD WORD GAME APPARATUS AND METHOD

BACKGROUND OF THE INVENTION

A. Field of the Invention

This invention relates to board games and the like and, in particular, to a board game in which words or parts of words are formed from game pieces bearing letters in successive turns by one (or more) player(s).

B. Prior Art

Word games of various kinds are known which can be played by one or more players. Some word games, such as crossword puzzles, require a puzzle chart which is numbered and divided into word-length segments. Crossword puzzles require a list of definitions of words, for both the horizontal and vertical spaces. Of course, formulation of the definitions of such words so as to properly intermesh in both directions is a rather tedious task demanding considerable thought, knowledge and research.

Other word games are known such as the one marketed under the trademark "Scrabble" by Selchow & Righter. That well-known game has a playing board divided into a number of discrete areas, some of which are coded with different colors for enhanced letter count. A number of tiles are also provided bearing, respectively, letters of a given alphabet of a given language. Usually the number of tiles bearing a particular letter corresponds to the frequency of occurrence of that letter in the language involved. A player or players in turn select a certain number of numerals at random and attempt to form a word in each turn which may be totally newly formed or formed by being added onto previously formed words. This is done by placing any number of the tiles in their hand on game areas, whether vertical or horizontal, on the playing board. The game continues until no more tiles can be played by a player to form an added-on or newly-formed word. The winner is determined to be the one who has formed words by tiles whose letter values generally add up to the highest total, some values being enhanced by the position of those tiles on premium areas on the board.

While it is true that Scrabble can be played in certain forms by a single player, its very nature lends itself especially to enjoyment by several players at a time.

It is therefore among the objects of the present invention to provide:

(1) A game which is especially adaptable for playing by a single person.

(2) A game which can be played in conjunction with game pieces from known word games.

(3) A game which is intellectually challenging and highly entertaining to a player or players of all ages and verbal capabilities.

Still other objects of the game will occur to the reader of this specification and the claims as well as the drawings illustrating several embodiments of it.

SUMMARY OF THE INVENTION

A playing surface is divided into a predetermined number of discrete playing areas, the areas bearing respective numerals in a normal arithmetic sequence. A plurality of game pieces are provided whose aggregate number approximates the number of the playing areas. They bear respective letters of the alphabet, the number of pieces bearing a particular letter of the alphabet corresponding generally to the normal frequency of occurrence of that letter in a predetermined language.

The player(s) makes successive random draws of a certain number of pieces and after each draw places the pieces of that draw in predetermined areas of the surface in positions which form a word or part of a word. The play of the pieces in each draw is usually accomplished by their placement in playing areas having higher numbers than those filled in the play of the previous draw. When it is no longer possible to do so, or if the player desires they may be played in a new circuit of the board in areas near the beginning which have lower numbers or in other areas.

BRIEF DESCRIPTION OF THE DRAWINGS

FIGS. 6A, 6B and 6C are diagrams illustrating selected stages of play of the game after differing numbers of draws of letters.

DETAILED DESCRIPTION OF THE DRAWINGS

Figure 1:
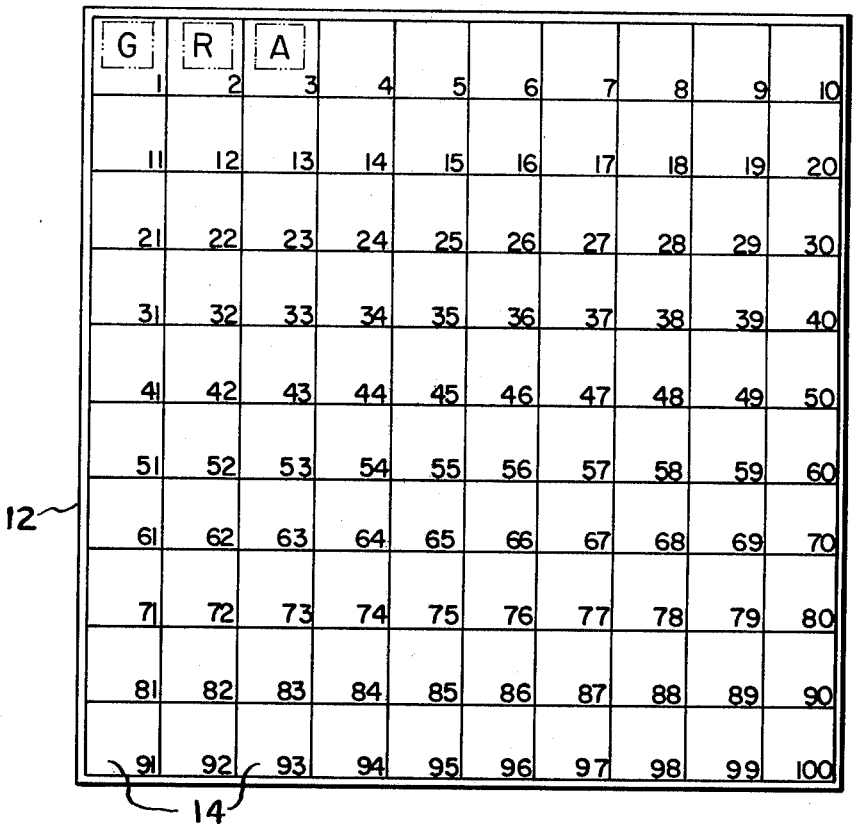
FIG. 1 depicts a playing board employed in one form of the present invention.
Figure 2:
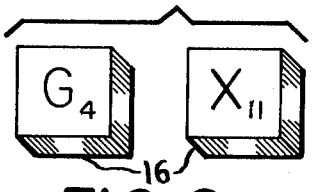
FIG. 2 shows a number of lettered tiles in perspective that may be used with the board shown in FIG. 1.

FIG. 1 shows a board 12 on which there are ten rows of discrete areas 14, each row having ten such areas. In each of the areas 14 there is a smaller numeral as indicated in a left to right normal reading sequence. FIG. 2 shows several tiles 16 bearing, respectively, the letters "G" and "X".

In one embodiment, there may be 108 tiles in all, the number of tiles 16 bearing a particular letter being determined largely by the normal frequency of occurrence of that letter in the language involved which, in the case illustrated, is English. Thus, for example, there would be ten "E" tiles, nine "A" tiles, seven "I" tiles, nine "O" tiles, and five "U" tiles which is a normal distribution for vowels. Tiles bearing consonants are present with corresponding frequencies such as seven tiles each which bear the letters "R," "S," and "T," six with "N," one each for "X" and "Z," etc. The tiles are scattered face down on a level surface or placed in a bag for random draw by hand. In the embodiment to be discussed below, one player will be assumed.

The game is conducted by making a number of successive "draws" of a predetermined number, say three, of the tiles. After each draw, the player will attempt to place the drawn lettered tiles within selected ones of the areas 14 of the board 12 in their proper relative positions that either form a word or part of a word. However, in the play of each successive draw, the player must put the lettered tiles of that draw down in numbered areas 14 which are higher than those used in the play of the preceding draw except in certain circumstances which will be explained later.

Accordingly, to begin the game the player picks up three of the tiles 16 at random from the surface on which, or from the bag in which, they have been placed. Assuming that in the first draw are tiles with the letters G, R, and A, the player must consider what words can incorporate them in the most productive way insofar as the objective of the game is concerned. One way of scoring the game is to give more points to words that are longer than to those which are shorter. Bearing that in mind, however, the player must also consider what remaining lettered tiles can appear in future draws, which must be played in successively higher numbered areas 14 until that is no longer possible. At that point, called a "turn-around," the player can place his tiles in unoccupied areas 14 toward the beginning areas of the board. In the particular embodiment to be explained, it is assumed that only seven turn-arounds are permitted whereupon the game is over. After each turn-around, successive draws must be played in successively higher-numbered unoccupied areas than in previous play.

Thus, in deciding into which of the lower-numbered areas 14 the tiles of the first draw will be placed, the player considers words such as "grab," "grade," "gracious," "graphic," "graduation," "grant," etc. In the example illustrated, the player decides to form a word starting with GRA, so he places the tiles bearing letters G, R and A in areas 1, 2, and 3. Of course, in forming a word or part of a word, the drawn letters need not be put down in successive areas 14, so that if the player had in mind the word "glare", for example, he could have put the G in area 1, the A in area 3, and the R in area 4. In our example, the player decided to use the sequence GRA because he realized that this sequence allows the formation of many words of varying lengths. Alternative plays of the three letters drawn in other sequences would be in GAR, RAG, RGA, AGR and ARG.

After the play of the first draw, the player draws three more tiles 16 bearing T,R, and L. He decides to put the T in areas 5, the R in area 7 and L in area 9. He has in mind the formation of the word "grant" and the possibility of the formation of the words "role", "roll", "rile", "rally", "rely", "reliance", etc. However, formation of any of the latter words can only be done after the next turn-around. To form "rally", moreover, the word would have to proceed onto the first area 14 of the second row. One of the rules of the game is that a space is to be left between successive words unless it ends in the last area 14 of a line in which case the next word can begin in the first area of the next lower line.

In the third and fourth draws, the letters V,G,T and A,W,U are drawn. The player decides to place letters V,G,T, in areas 11,13 and 15, possibly to form the word "vegetate" or "vegetable". The player can decide which word to form based upon his judgment of the number of high and low frequency tiles still unplayed. The play of the fourth draw is in 16, 21 and 23 with the A helping to form "vegetable" whereas the W and the U could later result in formation of the words "would," "wrung," "wound," etc.

The fifth draw of E, B and S poses a problem for the player. He could, for example, use them to help form the word "baseball" starting with the initial "B" in area 27, or other long words but instead sees an opportunity to help complete the very long word "vegetables." However, if he places the letters E, B, and S in the areas which have lower numbers than the highest number just played, i.e., area 23 containing the U of the previous play, he is deemed to have completely gone ahead past the last area 100 and started again toward the beginning of the board 12, i.e., to have made a turn-around. This means that he can only do this six more times, but he decides to do so anyhow, placing the letters E, B and S in areas 12, 17 and 20, respectively.

The player continues making successive draws in like fashion and playing them in successive plays as shown by the following table which shows draws 1 through 29 and their plays. The number of the draw is shown in the left column, the draw itself is shown in the middle column, and the correspondingly played areas in the right.

TABLE I

| No. of Draw | Draw | Areas Played |
|---|---|---|
| 1 | GRA | 1,2,3 |
| 2 | TRL | 5,7,9 |
| 3 | VGT | 11,13,15 |
| 4 | AWU* | 16,21,23 |
| 5 | EBS | 12,17,20 |
| 6 | NDS | 24,25,27 |
| 7 | ULU | 29,30,32 |
| 8 | MPO | 33,34,37 |
| 9 | IEA | 38,40,43 |
| 10 | IRY | 44,45,46 |
| 11 | HLM | 48,50,51 |
| 12 | TK[Z] | 53,57 |
| 13 | ERA | 58,59,62 |
| 14 | STQ | 63,64,67 |
| 15 | ATG | 69,71,73 |
| 16 | SYD | 77,78,81 |
| 17 | T*EE | 84,14,19 |
| 18 | DSA | 31,39,76 |
| 19 | IEB* | 82,83,86 |
| 20 | LOH | 18,22,42 |
| 21 | ER*N | 49,70,4 |
| 22 | WT[K] | 61,89 |
| 23 | VSO | 91,93,94 |
| 24 | S*OP | 97,28,36 |
| 25 | MUN | 55,68,88 |
| 26 | CR*[C] | 98,100 |
| 27 | OF[B] | 54,60 |
| 28 | EOI* | 65,74,92 |
| 29 | E[JN] | 87 |

It should be noted in the foregoing table that certain items are asterisked. This means that the play of the letters in the successive draw is in the board areas which have lower numbers than the highest-numbered played area of the previous draw, i.e, a turn-around occurs at this point. Also, certain letters are enclosed in brackets signifying that when drawn, that letter was not used in the formation of any word, but rather discarded. This occurs, for example, with the letter Z in draw 12, K in draw 22, etc. The possibility of discards is one reason for providing more tiles than game areas 14.

FIG. 6A shows the letters on the board after the completion of the play after the fifth draw which is the first turn-around. FIG. 6B shows the letters on the board after play of the draw 17. It should be noted that there is a turn-around as soon as play of the T in that draw has been made since the play of the next E is in the game area numbered 14 which is much lower than the play of the previous letter T in area 86. FIG. 6C shows the letters on the board after the play of draw 29. Even though the letter E is placed in area 87, the other letters of the draw, J and N are not capable of play on this circuit of the board so the game is effectively ended. An additional draw that might enable letters to be played in areas having numbers lower than those just played would result in a prohibited eighth turn-around.

A game can, however, also terminate if the player cannot play letter tiles on playing areas more than four times, i.e., if he attempts to discard a fifth time.

When the game has been completed for either of the above reasons, the player totals his score by computing the value of each word formed according to the following table.

TABLE II

| Letters in Word | Points |
|---|---|
| 2 | 10 |
| 3 | 20 |
| 4 | 40 |
| 5 | 60 |
| 6 | 100 |
| 7 | 150 |
| 8 | 200 |
| 9 | 250 |
| 10 (or more) | 300 |

After obtaining the total value of the words formed, the totals are measured according to the following table.

TABLE III

| PERFORMANCE RATING | |
|---|---|
| Points | Rating |
| 450 | Satisfactory |
| 625 | Good |
| 800 | Excellent |
| 975 | Outstanding |

From the totals above, if certain of the letters played do not form a word of two or more letters, five points per letter are deducted as a penalty, for example.

While the invention has been described as a type of solitaire game, it is possible for several players to compete. In one such form, two or more players, with their own playing boards kept from the view of the others, make plays based upon a common draw. The winner is the one who has the highest score when one of the players first declares that he has completed play because of the operation of the seven turn-around rule, or the five discard rule.

Another way for two or more to compete is to have them play the game after one another with the tiles drawn in the same draws for all.

Still another way is to have two or more teams or players with a common board, each team or player making draws in order and then playing the letters of each draw. Whenever a team or player completes a word, his score is increased by the value of that word in terms of points. In this form, if the rule of requiring a space between words is followed, a subsequent player cannot add on to words previously played. However, if that rule is dispensed with, add-ons can be permitted. At the time the game ends, the totals for each player or team are computed minus the usual penalties, the highest scoring player or team being declared the winner.

An alternative in scoring by length of word is to use tiles which also have on them a numeral which is inversely related to the frequency of the occurrence of that letter in the language involved. After the player or team completes the word, the total point value of that word is obtained by adding up all the numbers on each tile of that word. Tiles so numbered are shown at 16 in FIG. 2 and may be, for example, existing tiles so numbered used in other games of letter-word formation.

Figure 3:
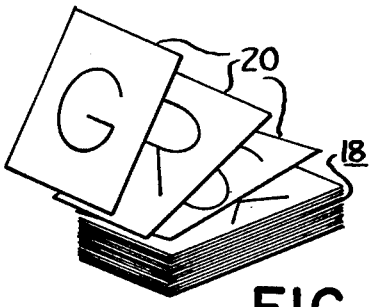
FIG. 3 shows lettered cards usable in still another form of the invention.

In the illustrations above, the tiles were mixed up and laid face down or within a bag for each random draw. Instead of that, however, a stack 18 of cards 20 as shown in FIG. 3, respectively bearing letters, may be used. To insure randomness, they are shuffled well before placing them face down upon the table for removal of three cards at a time for each draw. The letters of each draw are then played by marking them in desired ones of the areas of a chart which is printed on paper in the same way as the board shown in FIG. 1 is printed.

Figure 4:
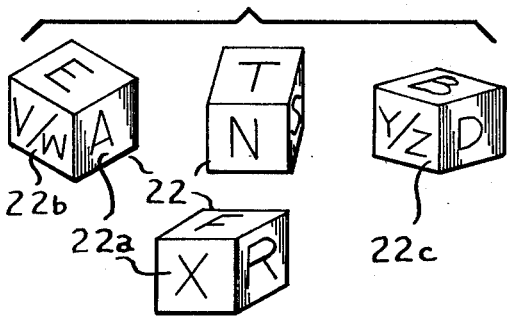
FIG. 4 shows special dice in perspective which can be used to generate random "draws" of letters for play on the playing board or playing surface to be marked.

Another way of determining which letters are drawn is to toss four dice 22 such as are shown in FIG. 4 and using the letters on the top four faces, as the letters to be marked on the chart. Each die has six faces **22*a* so that each face would contain at least one letter whereas two of them 22*b* and 22*c* would bear two letters, i.e. I/J, X/Z or V/W. This is because there are twenty-six letters of the alphabet and if just one letter per face were used only twenty-four would be represented. If these dice 22** were then rolled in successive draws, randomness would be assured, but unlike the tiles or cards, the frequency of occurrence of the letters on the top faces of the dice would not correspond to their natural frequency in the particular language in which the game is played. Since there are four dice, each draw would comprise four letters. To compensate for the larger draw, a larger playing board could be used.

Figure 5:
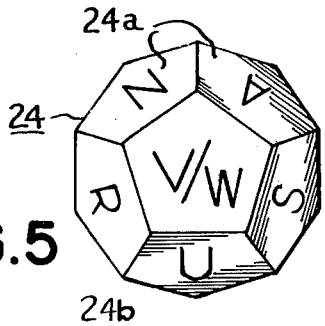
FIG. 5 shows a plan view of a lettered polyhedron which, with another, can be used to generate random draws of letters to be played.

Still another way of obtaining randomness, albeit, also not within the natural frequency curve of the language, would be to use a number of polyhedrons such as the pentagonal polyhedron 24 shown in FIG. 5. These polyhedrons 24 have twelve faces **24*a* so that two would have twenty-four. Most of the faces 24*a* would bear one letter but, if two are used and each draw is to comprise two letters, two of the faces such as 24*b* shown would also have to bear two letters as in the case of the four dice 22**. To compensate for the smaller draws, a smaller board could be used.

All of the foregoing concerned playing the game with game pieces, three-dimensional random letter selections such as lettered dice, and a three dimensional playing board. However, some embodiments of the game may dispense with a board and merely employ a printed sheet of paper in the general form of FIG. 1. The draws could be generated by random letter selectors or cards but instead of actually laying game pieces on the sheet, the player would merely mark the drawn letters in the desired playing areas on the sheet.

If it is desired to print the game in a periodical or newspaper, a possibly abbreviated form of playing pattern could be printed together with a predetermined, numbered sequence of draws and instructions for play and scoring. The player would mark in the letters of each predetermined draw in desired areas of the playing pattern as in the preceding embodiment.

The present game, whether played solitaire or by several people, can be alternatively played by terminating the game at the occurrence of events other than the inability to make plays except by starting a prohibited eighth turn-around. It can be played against time and when the time arrives, scores of all players are calculated minus the usual penalties. Another way is to play until one or more players completes a predetermined number of words or achieves the formation of a number of words whose letter value aggregates a certain sum.

While the game has been explained in terms of one that can be played with tiles or by working pre-printed sheets, it may take other forms as well. For example, it could be played on an electronic game device in which there is a display of one hundred cells headed by columns numbered 1–10 and rows headed A–J. A keyboard with all the letters on it is electronically linked to the display to allow insertion of any letter in any cell. Two other keys are provided for selecting the cell in which a letter is to be inserted, one designating the column, the other the row so that, for example, pressing keys "A" and "1" would enable only area 1 to be filled with a letter. Pressing keys "E" and "5" would enable area 45 to be filled with a desired letter.

Still other forms of the invention will occur to the reader which do not depart from the essence of the invention which should be limited solely by the claims which follows.

I claim:

1. A method of playing a game on a playing surface which is divided into a predetermined plurality of discrete areas bearing respective numerals in sequence which are to respectively receive game pieces bearing, respectively, letters of the alphabet comprising the steps of:

(a) selecting at random a number of said game pieces, (b) placing said selected game pieces on desired ones of said lower-numbered discrete areas in a sequence in which they are in relative positions that form a desired word or part of a word, (c) then selecting at random a number of the remaining game pieces, (d) then placing the last-mentioned selected game pieces on desired ones of said areas having numerals higher than the numerals of the previously selected areas in a sequence in which they are in relative positions that with or without the previously placed pieces form a desired word or part of a word, (e) repeating said steps c and d until the player cannot place a game piece of the latest selection in a higher-numbered area than those placed from the prior selection to form a word or partial word whereupon the player must place the piece or pieces of that selection in a lower-numbered area or areas toward the beginning of the sequence, (f) subsequently repeating steps c, d and e a number of times until the occurrence of a predetermined event whereupon said game is considered ended.

2. A method of playing a game on a playing surface which is divided into a predetermined plurality of discrete areas bearing respective numerals in sequence, comprising the steps of:

(a) selecting at random a predetermined number of letters of a give alphabet, (b) marking said selected letters on respective desired lower-numbered ones of said areas in a sequence in which they are in relative positions to form a word or part of a word, (c) then selecting again at random said predetermined number of letters of said alphabet, (d) then marking said last-mentioned selected letters in respective desired unoccupied other ones of said areas bearing numerals higher than the next previously selected areas and in a sequence in which they are in relative positions to form a word or part of a word, (e) repeating said steps (c) and (d) until the player does not desire to mark a letter of the latest selection in an area bearing a numeral higher than those marked in the next previously selected areas to form a word or part of a word, whereupon the player must mark a letter or letters of said latest selection in a respective unoccupied lower-numbered area or areas of said surface; and (f) subsequently repeating steps (c), (d) and (e) until the occurrence of a predetermined event.

3. A method of playing a game which includes a playing field divided into a number of discrete areas bearing substantially only respective numerals in a normal reading sequence, comprising the steps of:

(a) selecting at random a predetermined number of letters of a given alphabet, (b) associating said selected letters with respective desired lower-numbered ones of said areas in a sequence in which they are in relative positions to form a word or part of a word, (c) again selecting at random said predetermined number of letters of said alphabet, (d) then again associating said last-mentioned selected letters with respective desired other ones of said areas bearing numerals higher than the ones with which the next-previously selected letters were associated, and in a sequence in which they are in relative positions to form a word or part of a word, (e) repeating steps (c) and (d) until the player does not desire to associate a letter of the latest selection with an area bearing a numeral higher than those with which the next-previously selected letters were associated, whereupon the player must associate a letter or letters of said latest selection in a respective lower-numbered area or areas of said field; and (f) subsequently repeating steps (c) and (d) until the occurrence of a predetermined event.

4. The method according to claims 2 or 3 wherein said predetermined event occurs when a player has performed step (e) a predetermined number of times and thereafter continues play to the point at which he would otherwise be required to perform said step (e) one more time.

5. The method of claims 2 or 3 wherein the distribution of the total number of letters selectable by the player or players of said game generally corresponds to the normal frequency of occurrence of said letters in a predetermined language.

6. The method according to claims 2 or 3 wherein said game is considered ended and scored after step (f).

7. The method according to claims 2 or 3 wherein said game is scored as a function of the number of complete words formed.

8. The method according to claims 2 or 3 wherein said predetermined event is the lapse of a predetermined time.

* * * * *